US011830513B2

(12) United States Patent
Ahn et al.

(10) Patent No.: US 11,830,513 B2
(45) Date of Patent: Nov. 28, 2023

(54) METHOD FOR ENHANCING QUALITY OF AUDIO DATA, AND DEVICE USING THE SAME

(71) Applicants: DEEPHEARING INC., Daejeon (KR); The Industry & Academic Cooperation in Chungnam National University (IAC), Daejeon (KR)

(72) Inventors: Kanghun Ahn, Daejeon (KR); Sungwon Kim, Daejeon (KR)

(73) Assignees: DEEPHEARING INC., Daejeon (KR); The Industry & Academic Cooperation in Chungnam National University (IAC), Daejeon (KR)

( * ) Notice: Subject to any disclaimer, the term of this patent is extended or adjusted under 35 U.S.C. 154(b) by 0 days.

(21) Appl. No.: 18/031,268

(22) PCT Filed: Nov. 20, 2020

(86) PCT No.: PCT/KR2020/016507
§ 371 (c)(1),
(2) Date: Apr. 11, 2023

(87) PCT Pub. No.: WO2022/085846
PCT Pub. Date: Apr. 28, 2022

(65) Prior Publication Data

US 2023/0274754 A1 Aug. 31, 2023

(30) Foreign Application Priority Data

Oct. 19, 2020 (KR) ..... 10-2020-0135454

(51) Int. Cl.
*G10L 25/30* (2013.01)
*G10L 21/0264* (2013.01)
*G10L 25/18* (2013.01)

(52) U.S. Cl.
CPC ..... *G10L 21/0264* (2013.01); *G10L 25/18* (2013.01); *G10L 25/30* (2013.01)

(58) Field of Classification Search
CPC ..... G10L 25/18; G10L 25/30
(Continued)

(56) References Cited

U.S. PATENT DOCUMENTS 6,799,141 B1 * 9/2004 Stoustrup ..... H04L 25/0214 342/204
2014/0079248 A1 * 3/2014 Short ..... G10L 25/18 381/119

(Continued)

FOREIGN PATENT DOCUMENTS

KR 10-2020-0013253 A 2/2020

OTHER PUBLICATIONS

C. S. J. Doire, "Online Singing Voice Separation Using a Recurrent One-dimensional U-NET Trained with Deep Feature Losses," ICASSP 2019—2019 IEEE International Conference on Acoustics, Speech and Signal Processing (ICASSP), Brighton, UK, 2019, pp. 3752-3756, doi: 10.1109/ICASSP.2019.8683251. (Year: 2019).*

(Continued)

*Primary Examiner* — Bharatkumar S Shah
(74) *Attorney, Agent, or Firm* — Sughrue Mion, PLLC

(57) ABSTRACT

Provided is a method of enhancing quality of audio data which comprise obtaining a spectrum of mixed audio data including noise, inputting two-dimensional (2D) input data corresponding to the spectrum to a convolutional network including a downsampling process and an upsampling process to obtain output data of the convolutional network, generating a mask for removing noise included in the audio data based on the obtained output data and removing noise from the mixed audio data using the generated mask, wherein, in the convolutional network, the downsampling (Continued)

process and the upsampling process are performed on a first axis of the 2D input data, and remaining processes other than the downsampling process and the upsampling process are performed on the first axis and a second axis.

6 Claims, 6 Drawing Sheets

(58) Field of Classification Search
USPC ..... 704/244
See application file for complete search history.

(56) References Cited

U.S. PATENT DOCUMENTS

| | | | | |
|---|---|---|---|---|
| 2019/0318755 | A1 | 10/2019 | Tashev et al. | |
| 2019/0392852 | A1 | 12/2019 | Hijazi et al. | |
| 2020/0042879 | A1 | 2/2020 | Jansson et al. | |
| 2020/0243102 | A1 | 7/2020 | Schmidt et al. | |
| 2023/0197043 | A1* | 6/2023 | Martinez Ramirez | G06N 3/084 381/61 |

OTHER PUBLICATIONS

Hyeong-Seok Choi et al. "Phase-aware Speech Enhancement with Deep Complex U-Net", Published as a conference paper at ICLR, 2019, pp. 1-20.
Daiki Takeuchi et al., "Invertible DNN Based Nonlinear Time-Frequency Transform for Speech Enhancement", ICASSP, 2020, pp. 6644-6648.
Xiang Hao et al., "UNetGAN: A Robust Speech Enhancement Approach in Time Domain for Extremely Low Signal-to-noise Ratio Condition", Interspeech, Sep. 15-19, 2019, pp. 1786-1790.
Tomasz Grzywalski et al., "Using Recurrences in Time and Frequency Within U-Net Architecture for Speech Enhancement", ICASSP, 2019, pp. 6970-6974.
Request for the Submission of an Opinion for 10-2020-0135454 dated Jan. 28, 2022.
Request for the Submission of an Opinion for 10-2020-0135454 dated Jul. 19, 2022.
Korean Office Action for 10-2020-0135454 dated, Dec. 7, 2022.
International Search Report for PCT/KR2020/016507 dated, Jul. 19, 2021 (PCT/ISA/210).
Written Opinion of the International Searching Authority for PCT/KR2020/016507 (PCT/ISA/237).

* cited by examiner

FIG. 6

| Model | CSIG | CBAK | COVL | PESQ | SSNR |
|---|---|---|---|---|---|
| Noisy | 3.35 | 2.44 | 2.63 | 1.97 | 1.68 |
| SEGAN, 2017 | 3.48 | 2.94 | 2.80 | 2.16 | 7.73 |
| WAVENET, 2018 | 3.62 | 3.23 | 2.98 | – | – |
| MMSE-GAN, 2018 | 3.80 | 3.12 | 3.14 | 2.53 | – |
| DFL, 2018 | 3.86 | 3.33 | 3.22 | – | – |
| D+M, 2019 | 3.94 | 3.35 | 3.33 | 2.73 | 9.40 |
| Our Model | 3.95 | 3.41 | 3.39 | 2.83 | 9.54 |

METHOD FOR ENHANCING QUALITY OF AUDIO DATA, AND DEVICE USING THE SAME

CROSS REFERENCE TO RELATED APPLICATIONS

This application is a National Stage of International Application No. PCT/KR2020/016507 filed Nov. 20, 2020, claiming priority based on Korean Patent Application 10-2020-0135454 filed Oct. 19, 2020

TECHNICAL FIELD

The present invention relates to a method of enhancing the quality of audio data, and a device using the same, and more particularly, to a method of enhancing the quality of audio data using a convolutional network in which downsampling and upsampling are performed on a first axis of two-dimensional input data, and the remaining processing is performed on the first axis and a second axis, and a device using the method.

BACKGROUND ART

When pieces of audio data collected in various recording environments are exchanged with each other, noise generated for various reasons is mixed with the audio data. The quality of an audio data-based service depends on how effectively noise mixed with audio data is removed.

Recently, as video conferencing, in which audio data is exchanged in real time, is activated, a demand for a technology capable of removing noise included in audio data with a small amount of calculation is increasing.

DESCRIPTION OF EMBODIMENTS

Technical Problem

The present invention provides a method of enhancing the quality of audio data using a convolutional network in which downsampling and upsampling are performed on a first axis of two-dimensional input data, and the remaining processing is performed on the first axis and a second axis, and a device using the method.

Solution to Problem

According to an aspect of an embodiment, a method of enhancing quality of audio data may comprise obtaining a spectrum of mixed audio data including noise, inputting two-dimensional (2D) input data corresponding to the spectrum to a convolutional network including a downsampling process and an upsampling process to obtain output data of the convolutional network, generating a mask for removing noise included in the audio data based on the obtained output data and removing noise from the mixed audio data using the generated mask, wherein, in the convolutional network, the downsampling process and the upsampling process are performed on a first axis of the 2D input data, and remaining processes other than the downsampling process and the upsampling process are performed on the first axis and a second axis.

According to an aspect of an embodiment, the convolutional network may be a U-NET convolutional network.

According to an aspect of an embodiment, the first axis may be an frequency axis, and the second axis may be a time axis.

According to an aspect of an embodiment, the method may further comprise performing a causal convolution on the 2D input data on the second axis, wherein the performing of the causal convolution may comprise performing zero padding on data of a preset size corresponding to the past relative to the time axis in the 2D input data.

According to an aspect of an embodiment, the performing of the causal convolution may be performed on the second axis.

According to an aspect of an embodiment, a batch normalization process may be performed before the downsampling process.

According to an aspect of an embodiment, the obtaining of the spectrum of mixed audio data including noise may comprise obtaining the spectrum by applying a short-time Fourier transform (STFT) to the mixed audio data including noise.

According to an aspect of an embodiment, the method may be performed on the audio data collected in real time.

According to an aspect of an embodiment, an audio data processing device may comprise an audio data pre-processor configured to obtain a spectrum of mixed audio data including noise, an encoder and a decoder configured to input 2D input data corresponding to the spectrum to a convolutional network including a downsampling process and an upsampling process to obtain output data of the convolutional network and an audio data post-processor configured to generate a mask for removing noise included in the audio data based on the obtained output data, and to remove noise from the mixed audio data using the generated mask, wherein, in the convolutional network, the downsampling process and the upsampling process are performed on a first axis of the 2D input data, and remaining processes other than the downsampling process and the upsampling process are performed on the first axis and a second axis.

Advantageous Effects of Disclosure

A method and devices according to embodiments of the present invention may reduce the occurrence of checkerboard artifacts by using a convolutional network in which downsampling and upsampling are performed on a first axis of two-dimensional input data, and the remaining processing is performed on the first axis and a second axis.

In addition, a method and devices according to embodiments of the present invention may process collected audio data in real time by performing a causal convolution on 2D input data on a time axis.

BRIEF DESCRIPTION OF DRAWINGS

A brief description of each drawing is provided to more fully understand drawings recited in the detailed description of the present invention.

FIG. 6 is a table comparing performance according to a method of enhancing the quality of audio data according to an embodiment of the present invention with several comparative examples.

MODE OF DISCLOSURE

Figure 1:
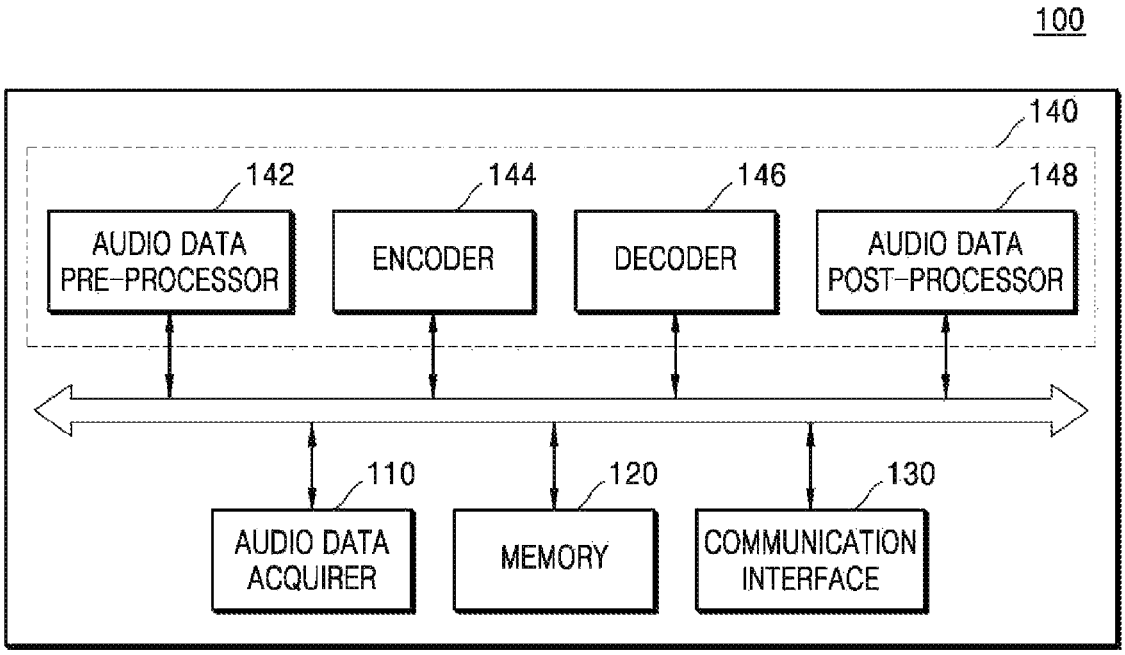
FIG. 1 is a block diagram of an audio data processing device according to an embodiment of the present invention.

Since the disclosure may have diverse modified embodiments, preferred embodiments are illustrated in the drawings and are described in the detailed description. However, this is not intended to limit the disclosure to particular modes of practice, and it is to be appreciated that all changes, equivalents, and substitutes that do not depart from the spirit and technical scope of the disclosure are encompassed in the disclosure.

In the description of the disclosure, certain detailed explanations of the related art are omitted when it is deemed that they may unnecessarily obscure the essence of the disclosure. In addition, numeral figures (e.g., first, second, and the like) used during describing the specification are just identification symbols for distinguishing one element from another element.

Further, in the specification, if it is described that one component is "connected" or "accesses" the other component, it is understood that the one component may be directly connected to or may directly access the other component but unless explicitly described to the contrary, another component may be "connected" or "access" between the components.

In addition, terms including "unit," "er," "or," "module," and the like disclosed in the specification mean a unit that processes at least one function or operation and this may be implemented by hardware or software such as a processor, a micro processor, a micro controller, a central processing unit (CPU), a graphics processing unit (GPU), an accelerated Processing unit (APU), a digital signal processor (DSP), an application specific integrated circuit (ASIC), and a field programmable gate array (FPGA) or a combination of hardware and software. Furthermore, the terms may be implemented in a form coupled to a memory that stores data necessary for processing at least one function or operation.

In addition, it is intended to clarify that the division of the components in the specification is only made for each main function that each component is responsible for. That is, two or more components to be described later below may be combined into one component, or one components may be divided into two or more components according to more subdivided functions. In addition, it goes without saying that each of the components to be described later below may additionally perform some or all of the functions of other components in addition to its own main function, and some of the main functions that each of the components is responsible for may be dedicated and performed by other components.

FIG. 1 is a block diagram of an audio data processing device according to an embodiment of the present invention.

Referring to FIG. 1, an audio data processing device 100 may include an audio data acquirer 110, a memory 120, a communication interface 130, and a processor 140.

According to an embodiment, the audio data processing device 100 may be implemented as a part of a device for remotely exchanging audio data (e.g., a device for video conferencing) and may be implemented in various forms capable of removing noise other than voice, and application fields are not limited thereto.

The audio data acquirer 110 may obtain audio data including human voice.

According to an embodiment, the audio data acquirer 110 may be implemented in a form including components for recording voice, for example, a recorder.

According to an embodiment, the audio data acquirer 110 may be implemented separately from the audio data processing device 100, and in this case, the audio data processing device 100 may receive audio data from the separately implemented audio data acquirer 110.

According to an embodiment, the audio data obtained by the audio data acquirer 110 may be wave form data.

In the specification, "audio data" may broadly mean sound data including human voice.

The memory 120 may store data or programs necessary for all operations of the audio data processing device 100.

The memory 120 may store audio data obtained by the audio data acquirer 110 or audio data being processed or processed by the processor 140.

The communication interface 130 may interface communication between the audio data processing device 100 and another external device.

For example, the communication interface 130 may transmit audio data in which the quality has been enhanced by the audio data processing device 100 to another device through a communication network.

The processor 140 may pre-process the audio data obtained by the audio data acquirer 110, may input the pre-processed audio data to a convolutional network, and may perform post-processing to remove noise included in the audio data using output data output from the convolutional network.

According to an embodiment, the processor 140 may be implemented as a neural processing unit (NPU), a graphics processing unit (GPU), a central processing unit (CPU), or the like, and various modifications are possible.

The processor 140 may include an audio data pre-processor 142, an encoder 144, a decoder 146, and an audio data post-processor 148.

The audio data pre-processor 142, the encoder 144, the decoder 146, and the audio data post-processor 148 are only logically divided according to their functions, and each or a combination of at least two of them may be implemented as one function in the processor 140.

The audio data pre-processor 142 may process the audio data obtained by the audio data acquirer 110 to generate two-dimensional (2D) input data in a form that can be processed by the encoder 144 and the decoder 146.

The audio data obtained by the audio data acquirer 110 may be expressed as Equation 1 below.

$$x_n = s_n + n_n \quad \text{(Equation 1)}$$

(where $x_n$ is a mixed audio signal mixed with noise, $s_n$ is an audio signal, $n_n$ is a noise signal, and n is a time index of a signal)

According to an embodiment, the audio data pre-processor 142 may obtain a spectrum $X_k^i$ of the mixed audio signal $x_n$ mixed with noise by applying a short-time Fourier transform (STFT) to the audio data $x_n$. The spectrum $X_k^i$ may be expressed as Equation 2 below.

$$X_k^i = S_k^i + N_k^i \quad \text{(Equation 2)}$$

(where $X_k^i$ is a spectrum of a mixed audio signal, $S_k^i$ is a spectrum of an audio signal, $N_k^i$ is a spectrum of a noise signal, i is time-step, and k is a frequency index)

According to an embodiment, the audio data pre-processor 142 may separate a real part and an imaginary part of a spectrum obtained by applying an STFT, and input the separated real part and imaginary part to the encoder 144 in two channels.

In the specification, "2D input data" may broadly mean input data composed of at least 2D components (e.g., time axis components or frequency axis components) regardless of its form (e.g., a form in which the real part and the imaginary part are divided into separate channels). According to an embodiment, "2D input data" may also be called a spectrogram.

The encoder 144 and the decoder 146 may form one convolutional network.

According to an embodiment, the encoder 144 may construct a contracting path including a process of downsampling 2D input data, and the decoder 146 may construct an expansive path including a process of upsampling a feature map output by the encoder 144.

A detailed model of the convolutional network implemented by the encoder 144 and the decoder 146 will be described later with reference to FIG. 2.

The audio data post-processor 148 may generate a mask for removing noise included in audio data based on output data of the decoder 146, and remove noise from mixed audio data using the generated mask.

According to an embodiment, the audio data post-processor 148 may multiply the spectrum $X_k^i$ of a mixed audio signal by a mask $M_k^i$ estimated by a masking method as shown in Equation 3 below to obtain a spectrum $\tilde{X}_k^i$ of an audio signal from which estimated noise has been removed.

$$\tilde{X}_k^i = M_t X_k^i \quad \text{(Equation 3)}$$

Figure 2:
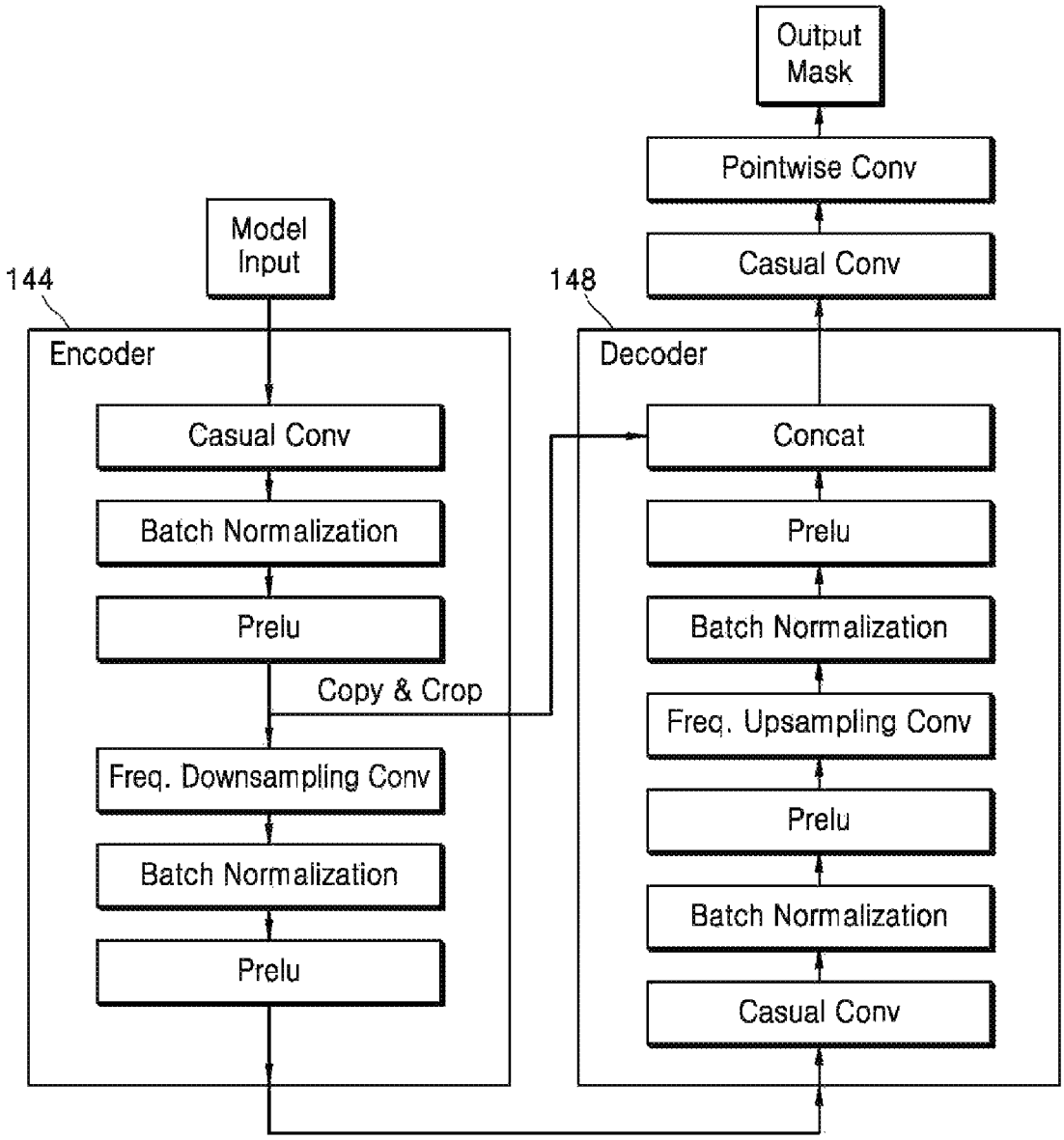
FIG. 2 is a view illustrating a detailed process of processing audio data in the audio data processing device of FIG. 1.

FIG. 2 is a view illustrating a detailed process of processing audio data in the audio data processing device of FIG. 1.

Referring to FIGS. 1 and 2, the audio data (i.e., 2D input data) pre-processed by the audio data pre-processor 142 may be input as input data (Model Input) of the encoder 144.

The encoder 144 may perform a downsampling process on the input 2D input data.

According to an embodiment, the encoder 144 may perform convolution, normalization, and activation function processing on the input 2D input data prior to the downsampling process.

According to an embodiment, the convolution performed by the encoder 144 may be a causal convolution. In this case, the causal convolution may be performed on a time axis, and zero padding may be performed on data of a preset size corresponding to the past relative to the time axis from among 2D input data.

According to an embodiment, an output buffer may be implemented with a smaller size than that of an input buffer, and in this case, the causal convolution may be performed without zero padding.

According to an embodiment, normalization performed by the encoder 144 may be batch normalization.

According to an embodiment, in a process of processing the 2D input data of the encoder 144, batch normalization may be omitted.

According to an embodiment, as an activation function, a parametric ReLU (PReLU) function may be used, but is not limited thereto.

According to an embodiment, after the downsampling process, the encoder 144 may output a feature map of the 2D input data by performing normalization and activation function processing on the 2D input data.

In the contracting path in the process of the encoder 144, at least a part of the result (feature) of the activation function processing may be copied and cropped to be used in a concatenate process (Concat) of the decoder 146.

A feature map finally output from the encoder 144 may be input to the decoder 146 and upsampled by the decoder 146.

According to an embodiment, the decoder 146 may perform convolution, normalization, and activation function processing on the input feature map before the upsampling process.

According to an embodiment, the convolution performed by the decoder 146 may be a causal convolution.

According to an embodiment, normalization performed by the decoder 146 may be batch normalization.

According to an embodiment, in a process of processing the 2D input data of the decoder 146, batch normalization may be omitted.

According to an embodiment, an activation function may be, but is not limited to, a PReLU function.

According to an embodiment, the decoder 146 may perform the concatenate process after performing normalization and activation function processing on a feature map after the upsampling process.

The concatenate process is a process for preventing loss of information about edge pixels in a convolution process by utilizing feature maps of various sizes delivered from the encoder 144 together with the feature map finally output from the encoder 144.

According to an embodiment, the downsampling process of the encoder 144 and the upsampling process of the decoder 146 are configured symmetrically, and the number of repetitions of downsampling, upsampling, convolution, normalization, or activation function processing may vary.

According to an embodiment, a convolutional network implemented by the encoder 144 and the decoder 146 may be a U-NET convolutional network, but is not limited thereto.

Output data output from the decoder 146 may output a mask (output mask) through post-processing of the audio data post-processor 148, for example, through casual convolution and pointwise convolution.

According to an embodiment, the causal convolution included in the post-processing process of the audio data post-processor 148 may be a depthwise separable convolution.

According to an embodiment, the output of the decoder 146 may be a two-channel output value having a real part and an imaginary part, and the audio data post-processor 148 may output a mask according to Equations 4 and 5 below.

$$Mmag = 2 * \tan h(|O|) \quad \text{(Equation 4)}$$

$$M = O * \frac{Mmag}{|O|} \quad \text{(Equation 5)}$$

(M is a mask, and O is a 2-channel output value)

The audio data post-processor 148 may obtain a spectrum of an audio signal from which noise has been removed by applying the obtained mask to Equation 3.

According to an embodiment, the audio data post-processor 148 may finally perform inverse STFT (ISTFT) processing on the spectrum of the audio signal from which noise has been removed to obtain waveform data of the audio signal from which noise has been removed.

According to an embodiment, in the convolutional network implemented by the encoder 144 and the decoder 146, the downsampling process and the upsampling process may be performed only on a first axis (e.g., a frequency axis) of the 2D input data, and the remaining processes (e.g., convolution, normalization, and activation function processing) other than the downsampling process and the upsampling process may be performed on the first axis (e.g., a frequency axis) and a second axis (e.g. a time axis). According to an embodiment, among the remaining processes other than the downsampling process and the upsampling process, the causal convolution may be performed only on the second axis (e.g., a time axis).

According to another embodiment, in the convolutional network implemented by the encoder 144 and the decoder 146, the downsampling process and the upsampling process may be performed on the second axis (e.g., a time axis) of the 2D input data, and the remaining processes other than the downsampling process and the upsampling process may be performed on the first axis (e.g., a frequency axis) and the second axis (e.g. a time axis).

According to another embodiment, when input data is 2D image data rather than audio data, a first axis and a second axis may mean two axes orthogonal to each other in the 2D image data.

Figure 3:
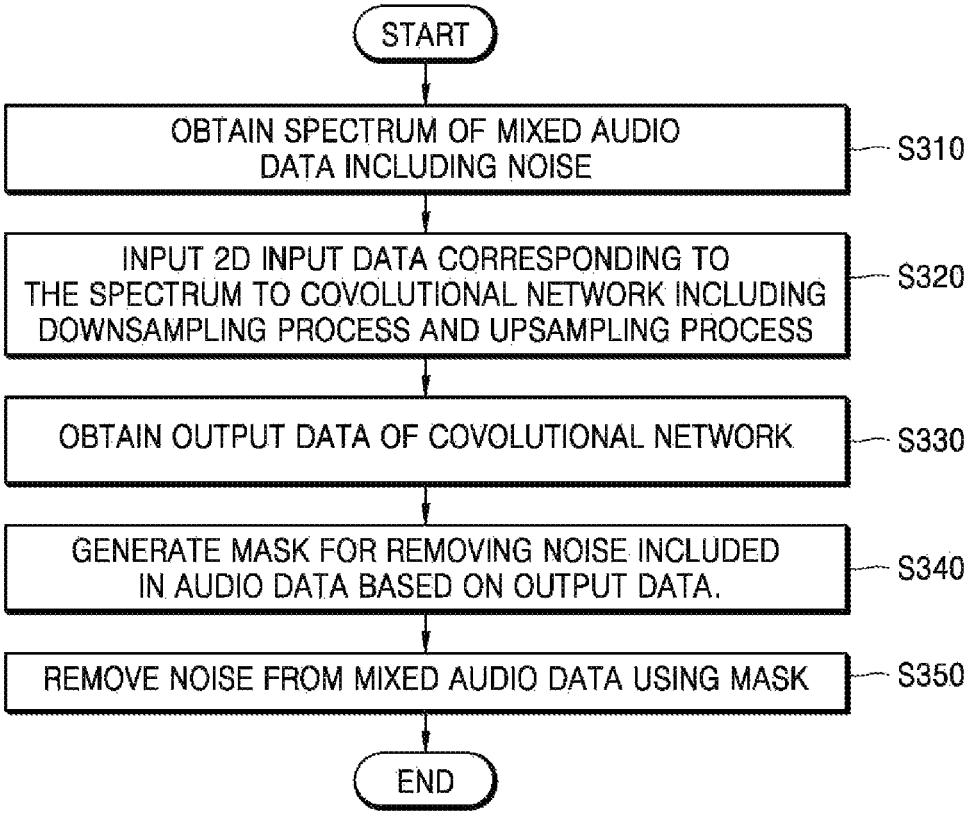
FIG. 3 is a flowchart of a method of enhancing the quality of audio data according to an embodiment of the present invention.

FIG. 3 is a flowchart of a method of enhancing the quality of audio data according to an embodiment of the present invention.

Referring to FIGS. 1 to 3, in operation S310, the audio data processing device 100 according to an embodiment of the present invention may obtain a spectrum of mixed audio data including noise.

According to an embodiment, the audio data processing device 100 may obtain a spectrum of mixed audio data including noise through an STFT.

In operation S320, the audio data processing device 100 may input 2D input data corresponding to the spectrum obtained in operation S310 to a convolutional network including a downsampling process and an upsampling process.

According to an embodiment, processing of the encoder 144 and the decoder 146 may form one convolutional network.

According to an embodiment, the convolutional network may be a U-NET convolutional network.

According to an embodiment, in the convolutional network, the downsampling process and the upsampling process may be performed on a first axis (e.g., a frequency axis) of the 2D input data, and the remaining processes (e.g., convolution, normalization, and activation function processing) other than the downsampling process and the upsampling process may be performed on the first axis (e.g., a frequency axis) and a second axis (e.g. a time axis). According to an embodiment, among the remaining processes other than the downsampling process and the upsampling process, a causal convolution may be performed only on the second axis (e.g., a time axis).

In operation S330, the audio data processing device 100 may obtain output data of the convolutional network, and in operation S340, may generate a mask for removing noise included in audio data based on the obtained output data.

In operation S350, the audio data processing device 100 may remove noise from the mixed audio data using the mask generated in operation S340.

Figure 4A:
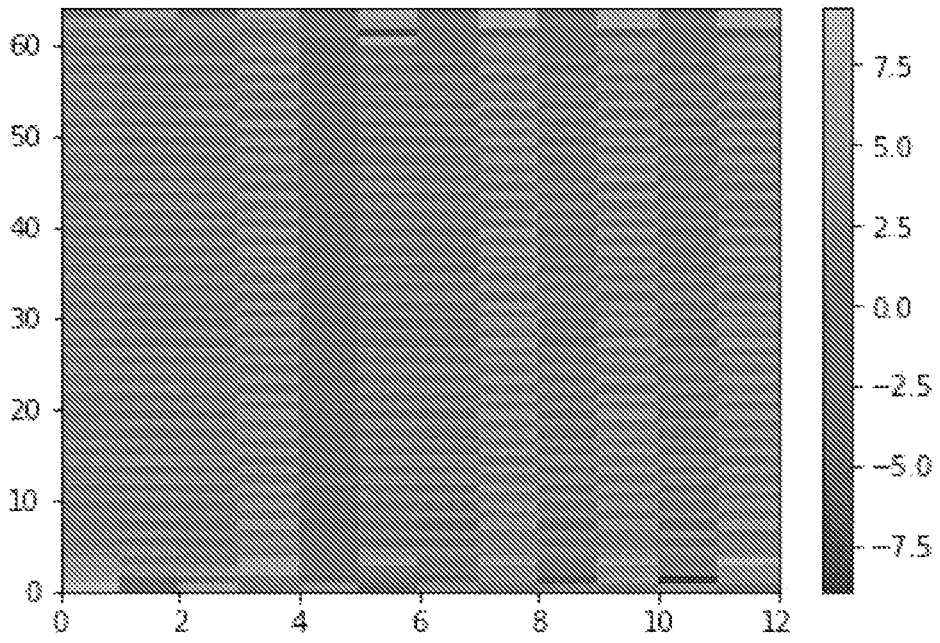
FIG. 4 is a view for comparing checkerboard artifacts according to a method of enhancing the quality of audio data according to an embodiment of the present invention with checkerboard artifacts according to a downsampling process and an upsampling process in a comparative example.
Figure 4B:
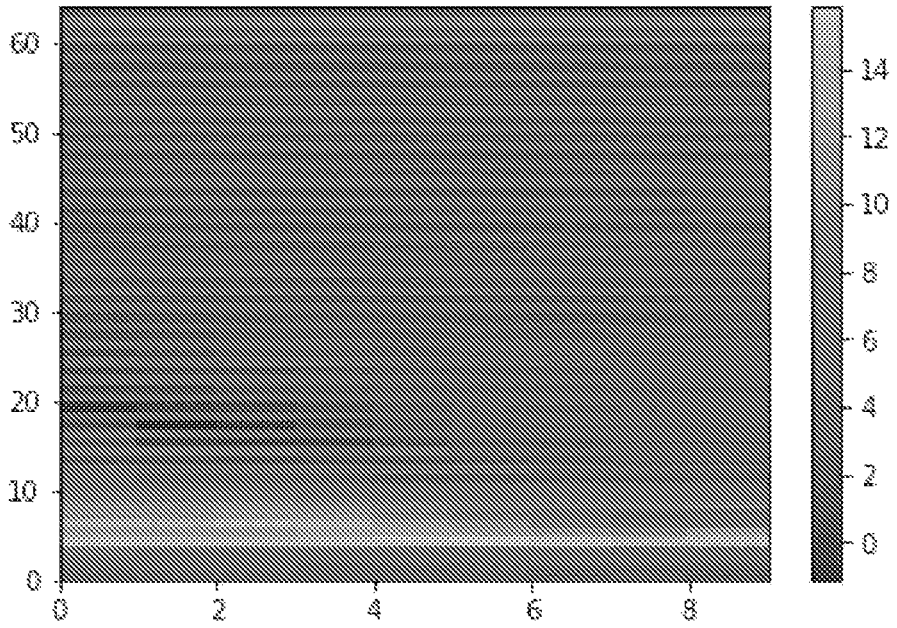

FIG. 4 is a view for comparing checkerboard artifacts according to a method of enhancing the quality of audio data according to an embodiment of the present invention and checkerboard artifacts according to a downsampling process and an upsampling process in a comparative example.

Referring to FIG. 4, FIG. 4 (*a*) is a view illustrating a comparative example in which a downsampling process and an upsampling process are performed on a time axis, and FIG. 4 (*b*) is a view illustrating 2D input data when a downsampling process and an upsampling process are performed only on a frequency axis and the remaining processes are performed on frequency and time axes according to an embodiment of the present invention.

As can be seen in FIG. 4, in the comparative example of FIG. 4 (*a*), a large number of checkerboard artifacts in the form of stripes appear in the audio data, and in the audio data processed according to the embodiment of the present invention in FIG. 4 (*b*), the checkerboard artifacts are relatively significantly improved.

Figure 5:
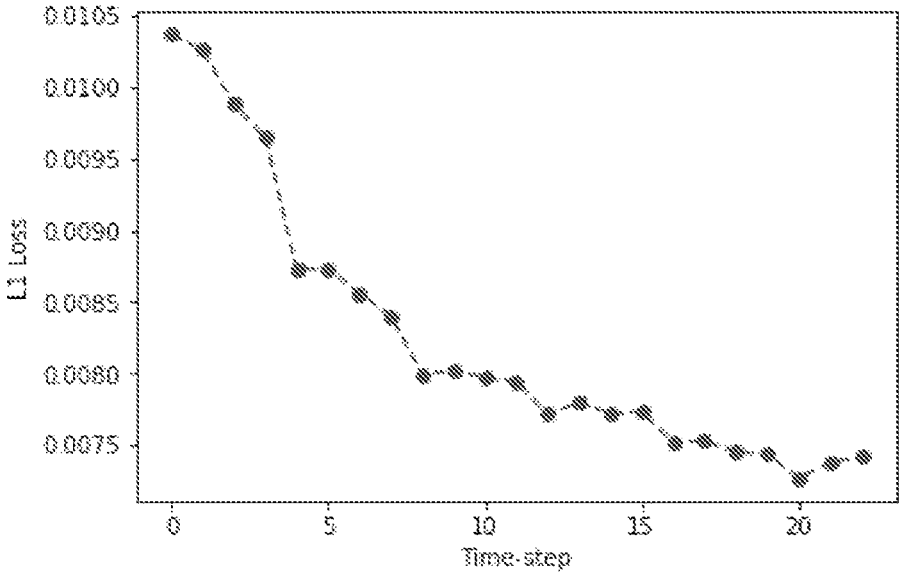
FIG. 5 is a view illustrating data blocks used according to a method of enhancing the quality of audio data according to an embodiment of the present invention on a time axis.

FIG. 5 is a view illustrating data blocks used according to a method of enhancing the quality of audio data according to an embodiment of the present invention on a time axis.

Referring to FIG. 5, L1 loss on a time axis of audio data is shown, and it can be seen that the L1 loss has a relatively small value in the case of a recent data block located on the right side of the time axis.

In the method of enhancing the quality of audio data according to an embodiment of the present invention, the remaining process other than a downsampling process and an upsampling process, in particular, a convolution process (e.g., a causal convolution), is performed on a time axis, and thus only boxed audio data (i.e., small amount of recent data) is used, which is advantageous for real-time processing.

FIG. 6 is a table comparing performance according to a method of enhancing the quality of audio data according to an embodiment of the present invention with several comparative examples.

Referring to FIG. 6, when our model according to the method of enhancing the quality of audio data according to an embodiment of the present invention is applied, it can be seen that CSIG, CBAK, COVL, PESQ, and SSNR values are all higher than when other models such as SEGAN, WAVENET, MMSE-GAN, deep feature losses, and coarse-to-fine optimization using the same data are applied, showing the best performance.

The invention claimed is:

1. A method of enhancing quality of audio data, the method comprising:

obtaining a spectrum of mixed audio data including noise;

inputting two-dimensional (2D) input data corresponding to the spectrum to a convolutional network including a downsampling process and an upsampling process to obtain output data of the convolutional network;

generating a mask for removing noise included in the audio data based on the obtained output data; and removing noise from the mixed audio data using the generated mask, wherein, in the convolutional network which is a U-NET convolutional network, the downsampling process and the upsampling process are performed only on a frequency axis of the 2D input data, and remaining processes other than the downsampling process and the upsampling process are performed on the frequency axis and a time axis, and wherein the method further comprises:

performing a causal convolution on the 2D input data on the time axis, wherein the performing of the causal convolution comprises:

performing zero padding on data of a preset size corresponding to the past relative to the time axis in the 2D input data.

2. The method of claim 1, wherein the performing of the causal convolution is performed on the time axis.

3. The method of claim 1, wherein a batch normalization process is performed before the downsampling process.

4. The method of claim 1, wherein the obtaining of the spectrum of mixed audio data including noise comprises:

obtaining the spectrum by applying a short-time Fourier transform (STFT) to the mixed audio data including noise.

5. The method of claim 1, the method being performed on the audio data collected in real time.

6. An audio data processing device comprising:

an audio data pre-processor configured to obtain a spectrum of mixed audio data including noise;

an encoder and a decoder configured to input 2D input data corresponding to the spectrum to a convolutional network including a downsampling process and an upsampling process to obtain output data of the convolutional network; and an audio data post-processor configured to generate a mask for removing noise included in the audio data based on the obtained output data, and to remove noise from the mixed audio data using the generated mask, wherein, in the convolutional network which is a U-NET convolutional network, the downsampling process and the upsampling process are performed only on a frequency axis of the 2D input data, and remaining processes other than the downsampling process and the upsampling process are performed on the frequency axis and a time axis, and wherein the encoder and the decoder performs a causal convolution on the 2D input data on the time axis, and wherein the causal convolution performs zero padding on data of a preset size corresponding to the past relative to the time axis in the 2D input data.

* * * * *